United States Patent [19]

Clark et al.

[11] Patent Number: 4,531,573

[45] Date of Patent: Jul. 30, 1985

[54] VARIABLE VOLUME MULTIZONE UNIT

[75] Inventors: William E. Clark, Syracuse; Donald C. Wellman, Marcellus, both of N.Y.

[73] Assignee: Carrier Corporation, Syracuse, N.Y.

[21] Appl. No.: 562,676

[22] Filed: Dec. 19, 1983

Related U.S. Application Data

[62] Division of Ser. No. 390,606, Jun. 21, 1982, Pat. No. 4,495,986.

[51] Int. Cl.[3] ..... F24F 3/044

[52] U.S. Cl. ..... 165/16; 165/22; 165/26; 165/27; 165/48 R; 98/39.1; 98/38.7; 236/1 B; 236/91 C; 236/91 E

[58] Field of Search ..... 165/2, 16, 22, 26, 27, 165/34, 35, 50, 48, 100, 101; 98/39, 38.7; 236/1 B, 91 C, 91 E

[56] References Cited

U.S. PATENT DOCUMENTS

| | | | |
|---|---|---|---|
| 2,372,839 | 4/1945 | McGrath | 165/16 |
| 2,806,675 | 9/1957 | Conradi | 165/50 |
| 2,885,187 | 5/1959 | Myck, Jr. | 236/1 B |
| 3,324,782 | 6/1967 | Norris et al. | 165/48 |
| 3,429,367 | 2/1969 | McGrath | 165/48 |
| 3,901,310 | 8/1975 | Strawn | 165/50 |
| 3,927,713 | 12/1975 | Gilles | 165/16 |
| 3,934,795 | 1/1976 | Ginn et al. | 165/27 |
| 4,044,947 | 8/1977 | Spethmann | 165/16 |
| 4,157,112 | 6/1979 | Swiderski | 165/50 |
| 4,182,484 | 1/1980 | Stanke | 165/26 |
| 4,203,485 | 5/1980 | Zilbermann et al. | 165/2 |
| 4,294,403 | 10/1981 | Ammons et al. | 165/27 |

FOREIGN PATENT DOCUMENTS

| | | | |
|---|---|---|---|
| 457313 | 6/1949 | Canada | 165/22 |

*Primary Examiner*—Albert W. Davis, Jr.
*Attorney, Agent, or Firm*—David J. Zobkiw

[57] ABSTRACT

A variable volume multizone unit is disclosed for simultaneously supplying variable amounts of cool, warm or neutral air to each zone, as required. The unit is under the overall control of a computer and controls dampers located at the unit to regulate the flow of cool and neutral or warm air to each zone individually and to control the total amount of air supplied to all of the zone.

8 Claims, 10 Drawing Figures

VARIABLE VOLUME MULTIZONE UNIT

This application is a division of applicaton Ser. No. 390,606, filed June 21, 1982, now U.S. Pat. No. 4,495,986 granted Jan. 29, 1985.

BACKGROUND OF THE INVENTION

In large buildings, such as office buildings, the core of the building is generally isolated from external environmental conditions. As a result, the core of a building is usually cooled year-round due to the heating load of the lights, machinery and personnel while the periphery of the building is heated or cooled, as required. Thus, in such buildings, there is ordinarily a concurrent demand for cooling and heating and/or neutral air to provide temperature regulation and to overcome air stagnation.

Various configurations have been employed to meet the differing demands of different parts of the system. In constant volume systems, a constant delivery fan is used and the dampers are linked together to provide a constant air flow with the character/temperature of the flow being thermostatically controlled. In variable volume systems, many means are used to control fan volume. The fan speed of a variable speed fan can be varied to match the system airflow and static pressure requirements while the individually controlled dampers regulate the flow in each zone. Other means of control are riding the fan curve, using inlet guide vanes and using discharge dampers. Minimum airflow is usually maintained in a variable volume air system, but in such systems the dampers are remotely located from the air handler. Additionally, in conventional variable volume systems, only cooled or neutral air is circulated in the system. At locations where heating is required, a local heat source, such as an electric resistance heater, is provided. The air to be heated is provided from a separate source, such as the ceiling plenum, and requires additional fans.

SUMMARY OF THE INVENTION

The present invention is directed to a variable air volume, zoned, blow through unit with integrally packaged controls. It is a total air conditioner which heats and cools without the mixing of heated and cooled air for temperature regulation. Each zone has a pair of independent, non-linked air dampers, a cooling damper and a neutral/heating damper, and individual zone heat coils. In effect, the variable volume multizone unit of the present invention incorporates the function of the remote "mixing box" into the air handling unit. Optionally, in one embodiment, when the outside air temperature is sufficiently low such that a mix temperature can be supplied to provide the cooling needed by the interior zones, the mechanical refrigeration system can be turned off. This is known as the economizer cycle or free cooling. Although the cooling coil is disabled in the economizer cycle, the cool air continues to pass therethrough so that the cooling damper can control the flow. When the outside air temperature is low enough for economizer cycle operation, some or all of the perimeter zones exposed to the low outside air temperature will ordinarily require heating. Thus, if the system is to be operated in the economizer cycle, a third independent damper would be provided to control the outside air at a second location. The return air, at say 80° F., would be mixed with the outside air, at say 30° F., to supply cooling air at 55° F. Because additional energy would be required to heat this air for those zones requiring heating, return air is supplied to the zones requiring heating with only the amount of outside air necessary for fresh air requirements being added. This reduces or eliminates the need for additional heat normally required in a multizone air handler in an economizer cycle.

It is an object of this invention to provide a multizone air conditioner that heats and cools without mixing heated and cooled air.

It is another object of this invention to provide a large zone, variable volume air conditioner with all of the functions located at the air handler except sensed zone temperature.

It is a further object of this invention to provide a two damper arrangement for supplying cool, neutral or warm air.

It is a further object of this invention to supply mixed outside air to those zones requiring cooling while supplying return air to the zones requiring heating to thereby minimize the need for additional heat during economizer cycle operation.

It is an additional object of this invention to control two independent dampers by the same sensor. These objects, and others as will become apparent hereinafter, are accomplished by the present invention.

Basically, the present invention consists of a plurality of zones supplied by a single variable speed fan and a single blow through cooling coil. Each of the zones has two independent dampers controlling respective flow paths. One damper is located in a first flow path downstream of the cooling coil and controls the cool air flow. The other damper is located in a second flow path upstream of a selectively operated zone heating coil and controls the neutral or warm air flow. The first and second flow paths combine downstream of the dampers.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
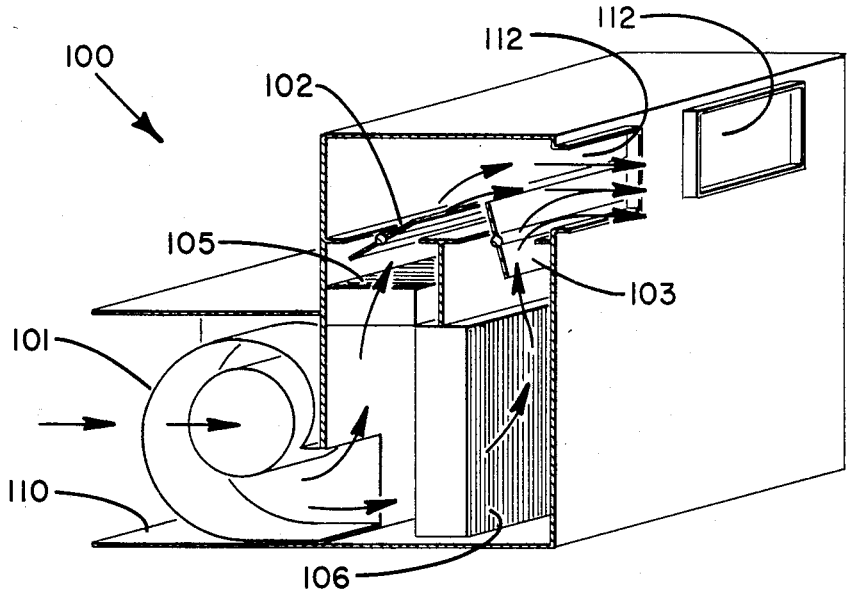
FIG. 1 PRIOR ART
FIG. 1 is a simplified sectional view of a prior art multizone unit.

In FIG. 1, the numeral 100 generally designates a standard multizone unit having an inlet 110 and a plurality of outlets 112 leading to each of the zones. This is a constant volume device that is required to supply cool, neutral and warm air simultaneously, as required by each zone. Each of the pairs of zone dampers 102 and 103 are linked, so that the total flow through both dampers of each zone remains constant. The dampers 102 and 103 are respectively located downstream of full heating coil 105 and full cooling coil 106. Constant volume fan 101 has a high energy requirement and supplies a fixed amount of air to each zone through full heating coil 105 and/or full cooling coil 106 before the air enters the various zones via the dampers 102 and 103 of each zone. Since dampers 102 and 103 are linked, hot and cold air are mixed to produce neutral air or to temper the mix temperature which is the case in all but the 100% heat or cool position of dampers 102 and 103 in which one damper is fully open and the other damper fully closed.

Figure 2:
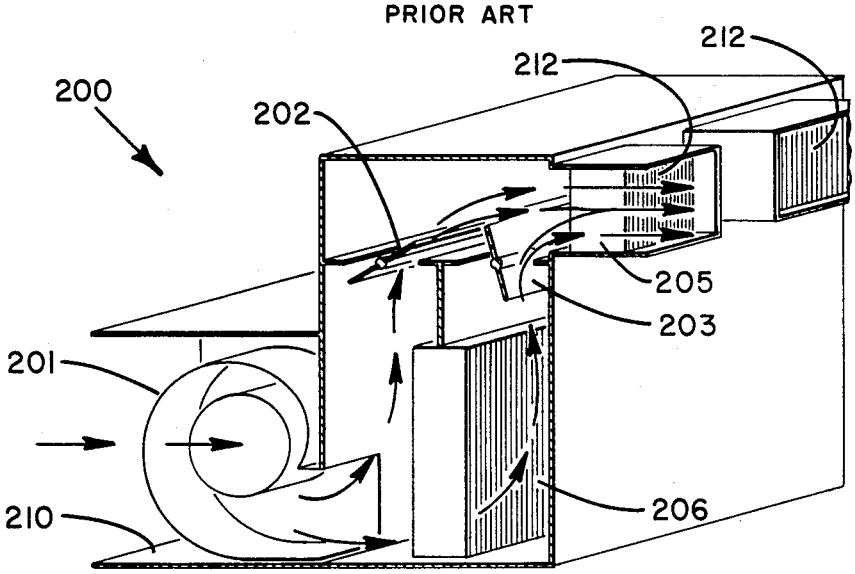
FIG. 2 PRIOR ART
FIG. 2 is a simplified sectional view of a prior art multizone unit with zoned reheat.

In FIG. 2, the numeral 200 generally designates a standard multizone unit with zoned reheat having an inlet 210 and a plurality of outlets 212 leading to each of the zones. This is a constant volume device that is required to supply cool, neutral and warm air simultaneously, as required by each zone. Each of the pairs of zone dampers 202 and 203 are linked so that the total flow into each of the zones remains constant. Both dampers of each zone are located upstream of the zone heating coil 205 with damper 203 being located downstream of full cooling coil 206 which provides the cooling for all of the zones. Constant volume fan 201 has a high energy requirement and supplies a fixed amount of air to each zone. The flow into each zone can be totally through cooling coil 206 or the flow may partially bypass the cooling coil 206 to temper the temperature of the cool air supplied. The flow into each zone can totally bypass the cooling coil 206 to supply neutral air and also to supply heat when coil 205 in the zone is activated. This system does not mix hot and cold air.

Figure 3:
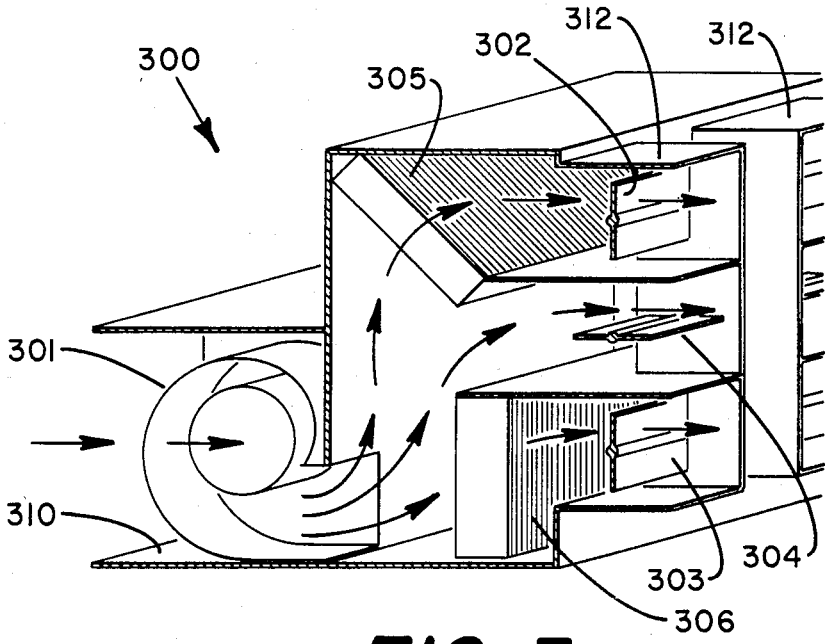
FIG. 3 PRIOR ART
FIG. 3 is a simplified sectional view of a prior art 3-deck multizone unit.

In FIG. 3, the numeral 300 generally designates a 3-deck multizone unit having an inlet 310 and a plurality of outlets 312 leading to each of the zones. This is a constant volume device that is required to supply cool, neutral and warm air simultaneously, as required by each zone. In each zone, the zone dampers 302, 303 and 304 are linked to maintain a constant air flow into each zone. Dampers 302 and 303 are respectively located downstream of full heating coil 305 andd full cooling coil 306 which, respectively, provide the heating and cooling for all of the zones. Constant volume fan 301 has a high energy requirement and supplies a fixed amount of air to each zone. The flow into each zone can be totally through heating coil 305 or cooling coil 306 as well as totally bypassing both and flowing into a zone through damper 304 as neutral air. Additionally, a mix of neutral and either warm or cool air may occur. This system does not mix hot and cold air.

The units 100, 200 and 300 previously described are each constant volume devices and for that reason are energy inefficient with respect to fan energy. Since the heating mode air flow requirement is not necessarily the full flow and since the neutral air requirement to prevent stagnation is about 25% that of the full flow, variable air volume (VAV) systems have been developed which use variable speed fans to vary the amount of air supplied to the system. Conventional VAV systems have one duct which branches to form the air distribution network. However, because one duct is used, VAV systems do not simultaneously supply cool, neutral and warm air. Typically, such a system supplies cool air or neutral air with heat being supplied in the zones by a separate heating system.

Figure 4:
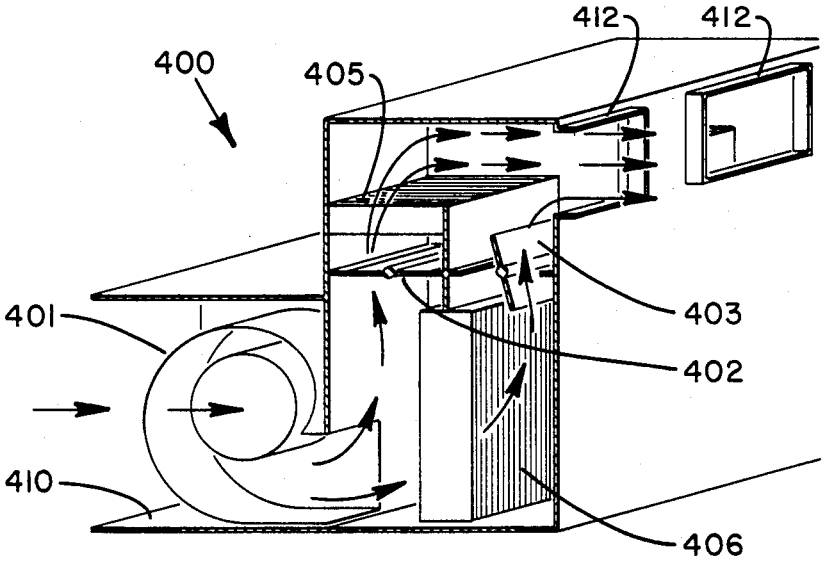
FIG. 4 is a simplified sectional view of the present invention.
Figure 5:
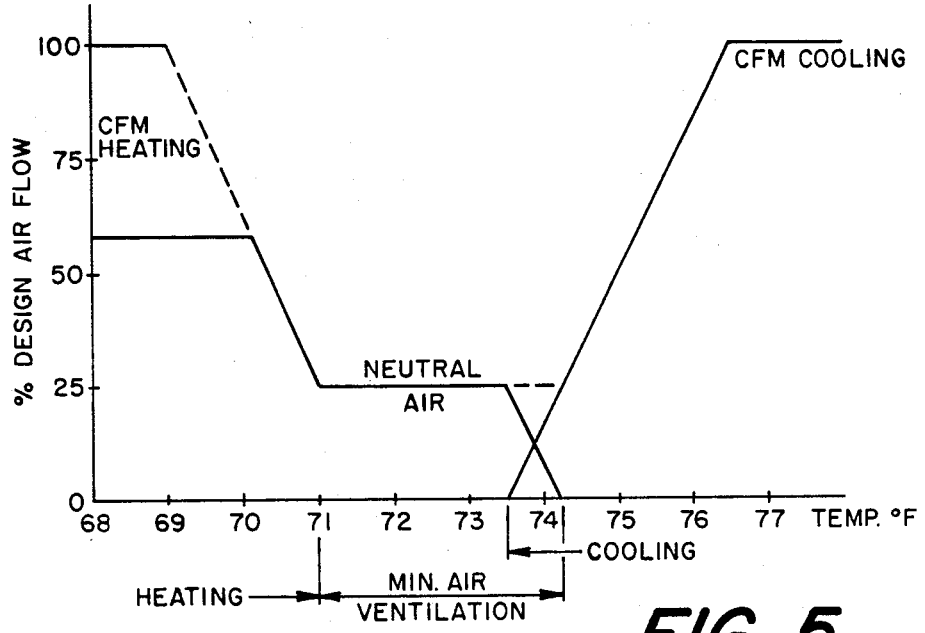
FIG. 5 is a graph showing a typical control sequence for the zone dampers.

In FIG. 4, the numeral 400 generally designates a variable volume multizone unit having an inlet 410 and a plurality of outlets 412 leading to each of the zones. This is a variable volume device that is required to supply cool, neutral and warm air simultaneously, as required by each zone. In each zone, the zone dampers 402 and 403 are separately controlled to vary the amount of air supplied to each zone according to zone requirements. Dampers 402 and 403 of each zone are respectively located upstream of the zone heating coil 405 and downstream of full cooling coil 406 which provides the cooling for all of the zones. This damper arrangement prevents coil wiping wherein the air flow in one flow path contacts or passes through the coil in the other flow path. Variable speed fan 401 has a low energy requirement due to its varying the total amount of air supplied to the system according to system demands. The flow into a zone can be totally through heating coil 405 or cooling coil 406 or a combination thereof. However, when the heating coil 405 of a zone is not activated, the zone damper 402 controls neutral air and the heating coil 405 in a zone cannot be operated while damper 403 is open in that zone. Referring now to FIG. 5, it will be seen that there is a neutral air region during which there is a preselected minimum air circulation of neutral air, generally about 25%, to prevent stagnation but no heating or cooling of air supplied to the zone except for the area of overlap between the minimum air ventilation and cooling ranges. During passage through this overlapping range, control passes between the cool and neutral air dampers, depending upon the direction of temperature change, and air is supplied through each damper with the total amount being the minimum air. This 2° or 3° F. range of neutral air preventss the blending of heated and cooled air as well as cycling since the heating or cooling is shut off at the extremes of this temperature range and there is a significant time period required for the zone to pass through the neutral air region. Additionally, this avoids the problem of dead band where there is no air motion when system temperature requirements are satisfied.

Figure 6:
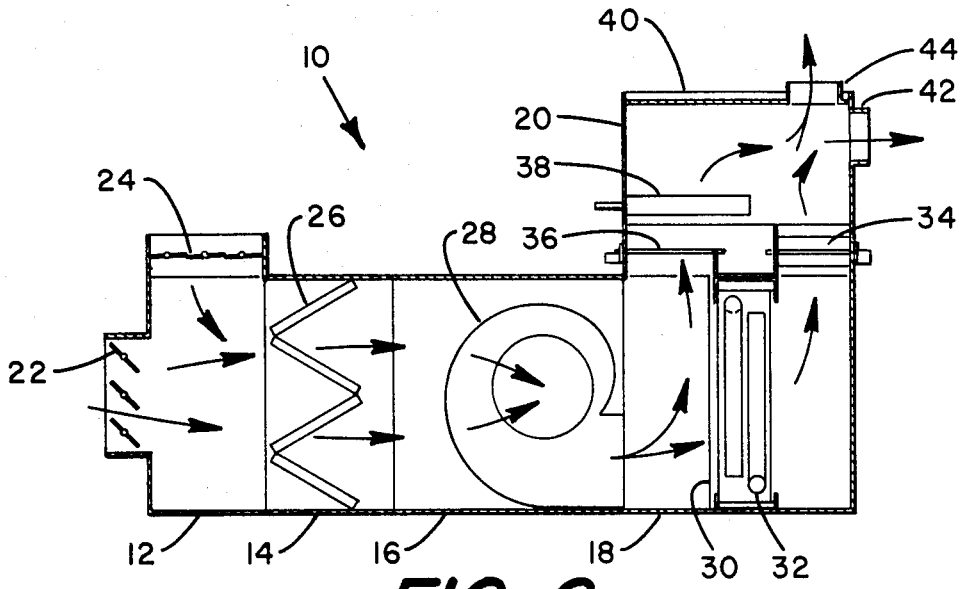
FIG. 6 is a more detailed view of the FIG. 4 device.
Figure 7:
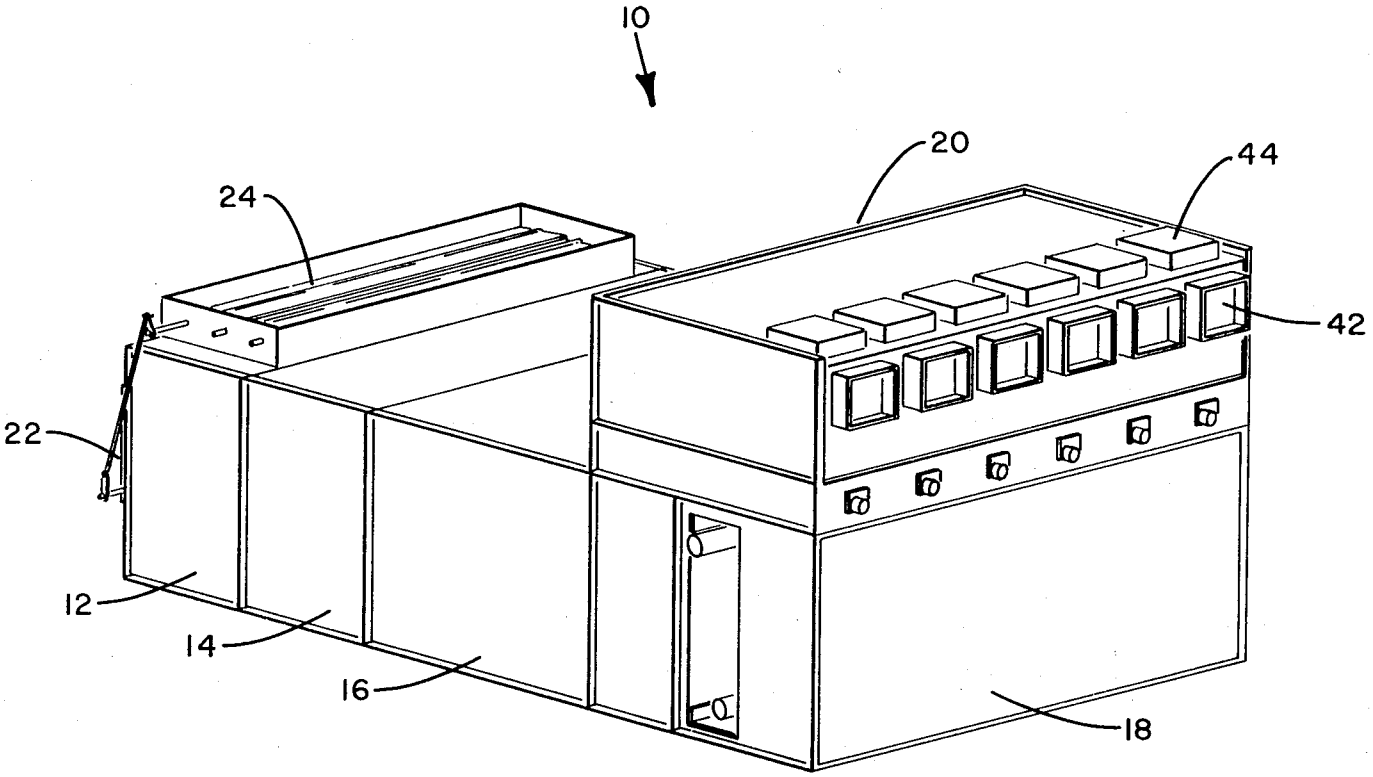
FIG. 7 is a pictorial view of the FIG. 6 device.
Figure 8:
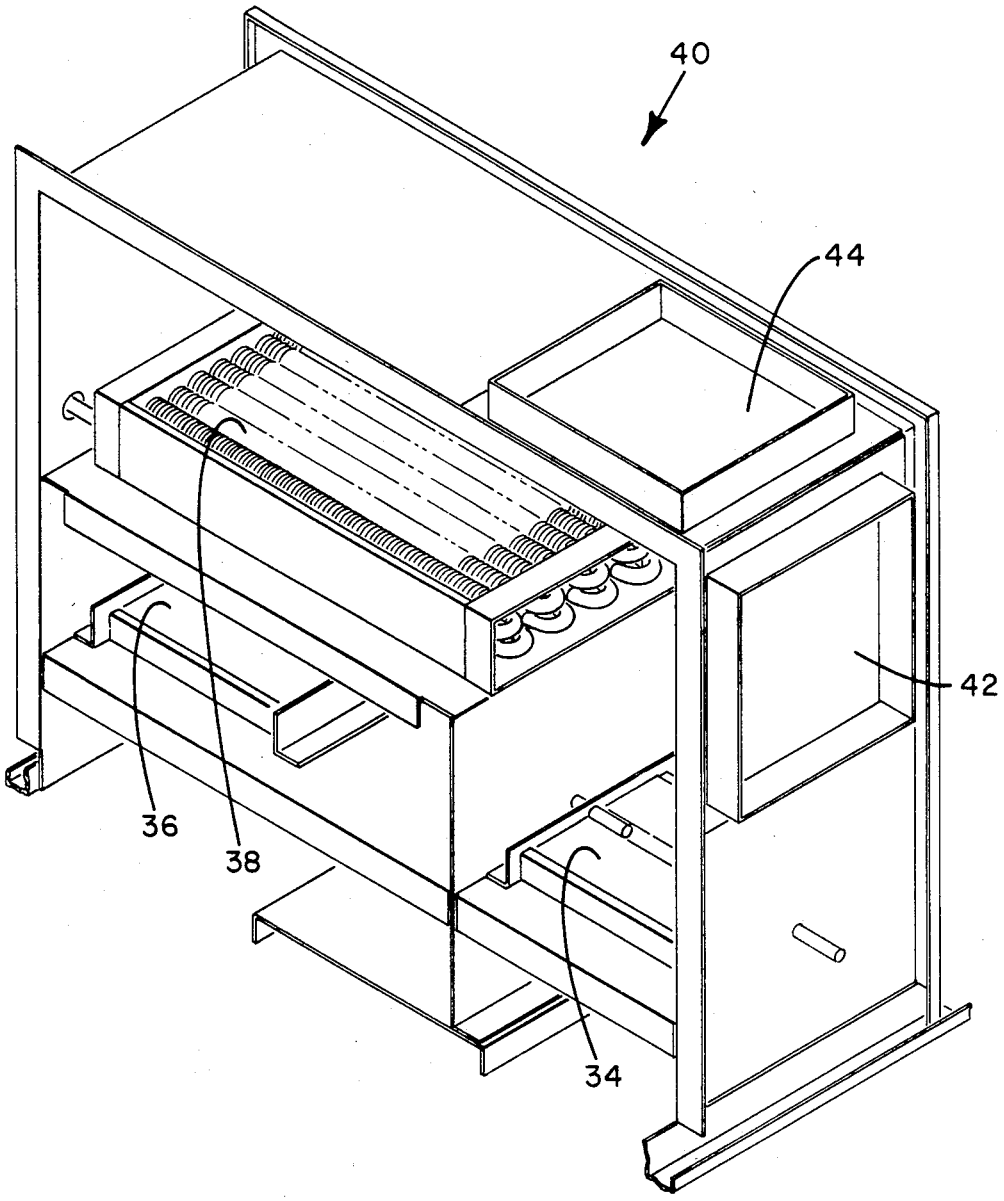
FIG. 8 is a pictorial view of a single zone portion of the variable multizone section.
Figure 9:
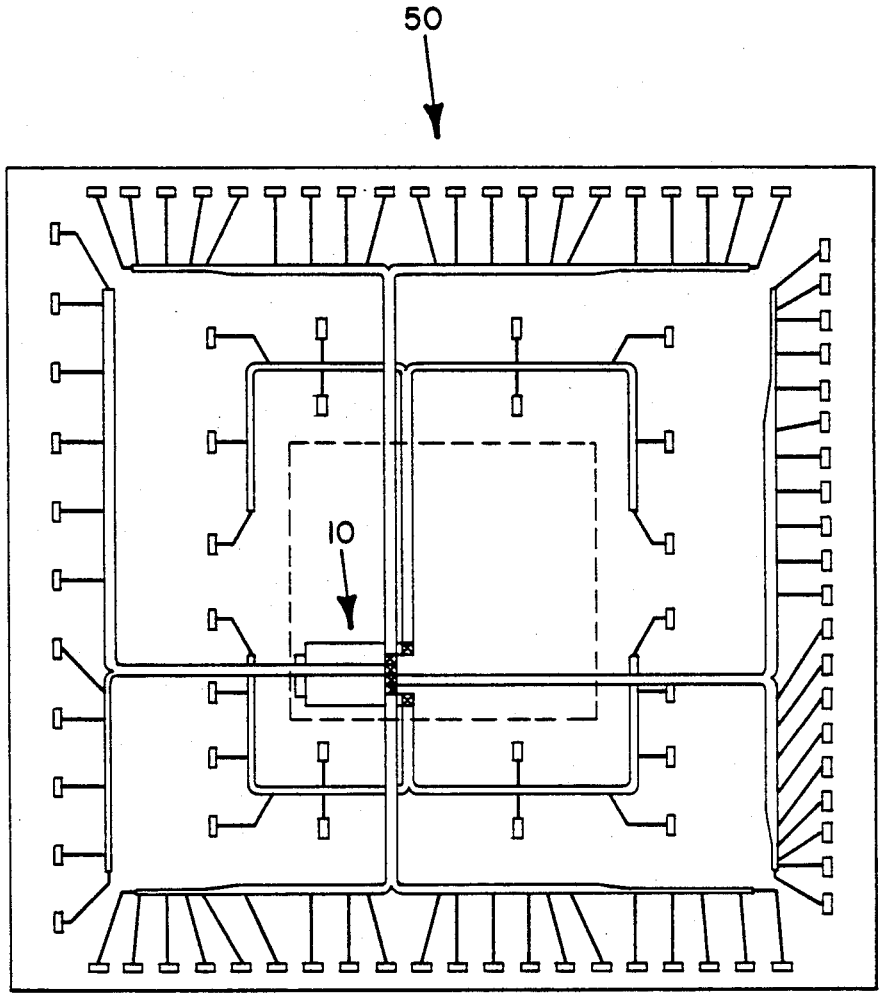
FIG. 9 is a schematic representation of an air distribution system using the present invention.

In FIGS. 6 and 7, the numeral 10 generally designates a variable volume multizone unit with just one zone supply being illustrated in FIG. 6. The variable volume multizone unit 10 is made up of mixing box 12, low velocity filter section 14, fan section 16, blow through coil section 18 and variable multizone section 20. The mixing box 12 is supplied with outside air or a return and outside air mixture via linked mixing box dampers 22 and 24, respectively. The outside air or return and outside air mixture is supplied to mixing box 12, passes through filter 26 in low velocity filter section 14 and is supplied to the inlet of variable speed fan 28. Fan 28 supplies air to the blow through coil section 18 in amounts determined by the speed of fan 28 and, up to this point, the flow path and structure only differs from that which is conventional for a VAV system in that it is a blow-through rather than a draw-through arrangement. Also, unlike a conventional VAV system, air passing from the blow through coil section 18 is divided for supply to the respective zones after passing through a zone section or unit 40 of variable multizone section 20. More specifically, air supplied by fan 28 to blow through coil section 18 passes into the zone sections 40 of variable multizone section 20 by either, or both, of two routes. The first route is through perforated plate 30 which provides good air distribution across the coil 32 when air is flowing through damper 34 but prevents cooling coil wiping by air flowing through damper 36. The flow then passes through chilled water coil 32 where the flow divides and passes through dampers 34 which respectively control the supply of cooling air to each zone. The second route into the zone sections 40 of multizone section 20 is via dampers 36 which respectively control the supply of neutral air to each zone. A zone hot water or electric heat coil 38 is located downstream of each damper 36 to prevent heating coil wiping as in the devices of FIGS. 1 and 3 and, when activated, heats the neutral air to supply warm air to the zone. The cool, neutral or warm air passes from each zone section or unit 40, as best shown in FIG. 8, by way of either a horizontal discharge 42 or a vertical discharge 44, as required, with the other discharge being blocked. FIG. 9 illustrates a six zone distribution system 50 employing the teachings of the present invention and having four perimeter and two interior zones. The system 50 would be under the control of a computer which would receive temperature data from each zone and velocity and temperature signal data from each zone supply to thereby control the dampers 34 and 36 for each zone responsive thereto to regulate the amount of air and the temperature of the air supplied to each zone. If there is a heating demand in any zone, the water or electric heat coil 38 would be activated in that zone as by opening a valve in the case of a hot water coil or supplying electric power in the case of an electric coil. The speed of fan 28 would be controlled in response to the load requirements.

Figure 10:
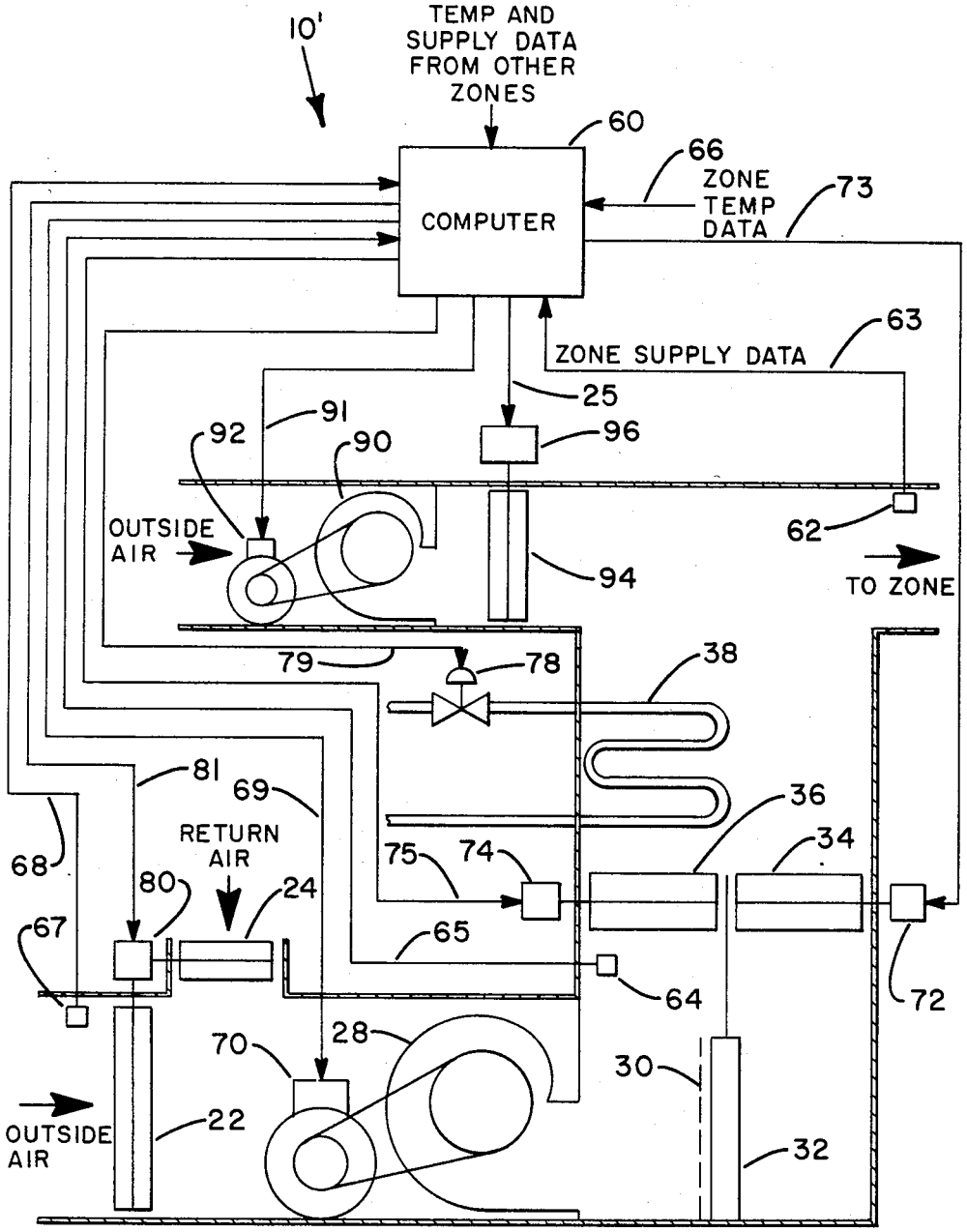
FIG. 10 is a schematic representation of the control system of a modified device that can employ an economizer cycle.

A schematic of the control system for a single zone is illustrated in FIG. 10 wherein 60 generally designates a microprocessor or computer which would control the system 50. Computer 60 receives zone supply velocity and temperature data from the zone supply sensor 62 via line 63 and this data represents the condition of the air supplied to the zone. Similarly, fan discharge temperature sensor 64 furnishes air supply temperature data to computer 60 via line 65. A zone sensor (not illustrated) supplies zone temperature data to computer 60 via line 66. Responsive to the velocity and temperature sensed by sensor 62 and the temperature data supplied via line 66, computer 60 controls fan motor 70 via line 69 and thereby causes fan 28 to speed up or slow down, as required by all the zones. Computer 60 receives zone temperature and zone supply data for each zone with lines 63 and 66 being illustrated and representing the data for one zone. Additionally, outside air temperature sensor 67 furnishes ambient temperature data to computer 60 via line 68 so that the unit can be run on the economizer cycle as will be described in detail below.

Each of the zones is controlled through dampers 34 and 36 which are respectively independently positioned by motors 72, and 74 which are controlled by computer 60 via lines 73 and 75, respectively. As best shown in FIG. 5, the dampers 34 and 36 are controlled such that only neutral air is supplied over a temperature range to prevent stagnation as well as to prevent cycling and simultaneous heating and cooling in a zone. For example, heating can take place when the zone temperature is 71° F., or less, and cooling can take place when the zone temperature is 74° F., or more, but between 71° F. and 74° F. only neutral air is supplied and at a minimum quantity, e.g. 25%, to prevent stagnation.

In the cooling mode, initially all air is supplied to the zone through cooling zone damper 34. Damper 34 is regulated by motor 72 under the control of computer 60 in response to the zone temperature data supplied via line 66. The computer 60 acts to maintain the cooling set point temperature of the zone. At low cooling loads, where cool air quantity falls below minimum air quantity for good air distribution and fresh air requirements, minimum air is maintained by the controlled opening of neutral air damper 36 under the control of computer 60 which senses the air volume via the zone supply sensor 62. The maintenance of minimum air quantity between the cooling and heating modes eliminates the dead band air stagnation problem experienced with some VAV systems.

The automatic changeover to the heating mode takes place at the heating set point. All air is passing through the neutral air damper 36 at changeover since the cooling zone damper 34 would be closed in passing through an adjustable range of 71°-74° F. for example, and only minimum neutral air would be supplied. The air quantity in the heating mode ranges between minimum air and 100% of the cooling air quantity. Neutral air damper 36 of each zone is modulated under the control of computer 60 to balance the zone heating load. The zone load for each zone is additionally balanced by a two position valve 78 which is controlled by computer 60 via line 79 and controls the flow of hot water to the zone heating coils 38. Alternatively, an electric heating coil (not illustrated) can be controlled.

The system can be operated in an economizer cycle by controlling linked mixing box dampers 22 and 24 via line 81 and motor 80 to supply respectively outside air, or a mixture of return and outside air. When the outside air temperature, as sensed by sensor 67, is above the cooling set point, supply air consists of return air and a minimum amount of outside air for the fresh air makeup requirement. When the outside air temperature falls below the space cooling set point, supply air consists of all outside air and if the outside air temperature is below 60° F., for example, mechanical cooling is shut down but all cooling air passes through cooling air zone damper 34 for control. As outside temperature falls, mixing box dampers 22 and 24 are modulated to maintain a fan discharge temperature of 60° F. The cooling zone damper 34 is modulated to maintain the space temperature set point. Alternatively, enthalpy, rather than outside air temperature, may be used in controlling the economizer cycle.

As noted above, computer 60 monitors the air volume and the zone temperatures. If the zone dampers are throttled and space temperatures are satisfied in each of the zones, computer 60 will reduce the speed of fan 28. After a given time delay, the system is remonitored and if the above conditions still exist, the fan speed is reduced again until one zone damper is fully open with the space temperature satisfied. However, if a zone damper is fully open and the space temperature is not satisfied, computer 60 causes an increment of fan speed increase.

Under some circumstances it becomes more energy efficient to supply outside air to a zone section from a separate fan powered source through fan 90 and a third damper 34 under the control of the computer 60 via line 91 and motor 92 and via line 95 and motor 96, respectively. If, for example, there is a cooling requirement in one or more zones and the outside temperature is such that mechanical cooling is not needed, but heating would be required in the other zones, it may be desirable to have two separate air supplies. More specifically, the multizone unit 10 of FIGS. 6 and 7 can be modified to the multizone unit 10' of FIG. 10 by providing a third damper 94 and a second varible speed fan 90 with their related ccontrols while all of the other structure remains the same. The third damper 94 need not be provided for each zone as the exterior zones will generally not be on the economizer cycle since they will generally require heat or neutral air under the condition of economize cycle use. The mixing box dampers 22 and 24 will be set to provide minimum outside air to meet fresh air requirements and to thereby minimize the heating of the air to supply warm air to those zonnes requiring heat. For those zones requiring cooling however, cold outside air would be supplied by variable speed fan 90 via damper 94 and would be tempered, as required, by neutral air supplied via neutral air damper 36.

In summary, the present invention discloses a variable air volume zoned, blow through unit in which each zone has a cooling air damper, and neutral/heating air damper and either electric or hot water heat. The system is under the overall control of a computer and the system preferably includes a variable speed fan and an economizer damper(s). The control system of the present invention provides occupant comfort by the predetermined operation of several electromechanical control elements which control zone air volume flow directly and zone temperature indirectly. The system is capable of simultaneously supplying cool or neutral air to each multizone section. Where heat is required, the neutral air is heated in the multizone section before being supplied to the zone.

Although preferred embodiments of the present invention have been illustrated and described, other changes will occur to those skilled in the art. For example, the variable speed fan can be controlled in response to flow and damper position, and the damperss can be regulated proportionally by space temperature. It is therefore intended that the scope of the present invention is to be limited only by the scope of the appended claims.

What is claimed is:

1. A variable volume multizone system for simultaneously supplying warm, cool and neutral air, as required, to a plurality of zones from a common source comprising:

a variable volume air supply means for supplying air in required amounts;

air cooling means;

a variable multizone section divided into a plurality of units corresponding to the number of zones;

each of said units having a first inlet controlled by a first individual damper means, a second inlet controlled by a second individual damper means, an outlet for supplying conditioned or netural air to a zone and heating means located downstream of said second damper means such that all air flowing into said unit through said second damper means must subsequently pass through said heating means;

a first flow path between said air supply means and said outlet of each of said units for supplying cool air, as required, to each zone and serially including said air cooling means and the first damper means of each of said zones;

a second flow path between said air supply means and said outlet of each of said units for supplying heated and neutral air, as required, to each zone and serially including said second damper means and said heating means of eacch of said zones and excluding said air cooling means.

2. The variable volume multizone system of claim 1 further including means responsive to the temperature in each zone for individually controlling said first and second damper means and said heating means in each zone and said air supply means so as to control the total amount of air supplied to said system and each of said zones.

3. The variable volume multizone system of claim 1 further including means responsive to the temperature in each zone and to the velocity of the air supplied to each zone for individually controlling said first and second damper means and said heating means in each zone and said air supply means so as to control the total amount of air supplied to said system and each of said zones and to maintain at least a selected minimum air flow in each zone independent of temperature control requirements.

4. The variable volume multizone system of claim 1 further including means responsive to the temperature in each zone and to the temperature of the air supplied to each zone for individually controlling said first and second damper means and said heating means in each zone and said air supply means so as to control the total amount of air supplied to said system and each of said zones and to maintain at least a selected minimum air flow in each zone independent of temperature control requirements.

5. The variable volume multizone system of claim 1 wherein at least one of said units has a third inlet controlled by a third individual damper means and further including a second variable volume air supply means for supplying air to said at least one unit through said third inlet.

6. Apparatus for supplying a variable volume of warm, cool or neutral air to a zone from a common source comprising:

a variable volume air supply means for supplying air in required amounts;

air cooling means;

an air distribution unit having a first inlet controlled by a first individual damper means, a second inlet controlled by a second individual damper means, an outlet for supplying air to a zone and heating means located downstream of said second damper means such that all air flowing into said unit through said second damper means must subsequently pass through said heating means;

a first flow path between said air supply means and said outlet for supplying cool air, as required, to said zone and serially including said air cooling means and said first damper means;

a second flow path between said air supply means and said outlet for supplying heated and neutral air, as required, to said zone and serially including said second damper means and said heating means and excluding said air cooling means; and means responsive to the temperature in said zone for controlling said first and second damper means and said heating means to cause warm, cool or neutral air to be supplied to said zone, as required, in temperature and amount.

7. The apparatus of claim 6 including a plurality of air distribution units each of which is in fluid communication with said air supply means, said air cooling means and a zone.

8. The apparatus of claim 6 wherein said means responsive to the temperature additionally controls said air supply means to control the amount of air supplied.

* * * * *